United States Patent [19]

Crabtree

[11] Patent Number: 4,595,176

[45] Date of Patent: Jun. 17, 1986

[54] LATCH FOR LIVESTOCK PANELS

[76] Inventor: Charley B. Crabtree, R.R. 3, Box 74, Mt. Vernon, Mo. 65712

[21] Appl. No.: 648,960

[22] Filed: Sep. 10, 1984

[51] Int. Cl.[4] ..... B21F 27/00; E04H 17/02

[52] U.S. Cl. ..... 256/52; 256/47

[58] Field of Search ..... 256/34, 47, 33, 52, 256/48

[56] References Cited

U.S. PATENT DOCUMENTS

| | | | |
|---|---|---|---|
| 273,887 | 3/1883 | Petriquin . | |
| 314,877 | 3/1885 | Rains et al. . | |
| 716,837 | 12/1902 | Gordon . | |
| 930,792 | 8/1909 | Perry . | |
| 2,152,816 | 4/1939 | Olson . | |
| 3,371,911 | 3/1968 | Parisien | 256/47 |

FOREIGN PATENT DOCUMENTS

| | | | |
|---|---|---|---|
| 513822 | 12/1930 | Fed. Rep. of Germany | 256/33 |
| 1097903 | 1/1968 | United Kingdom | 256/48 |

*Primary Examiner*—Andrew V. Kundrat

*Attorney, Agent, or Firm*—D. A. N. Chase; Michael Yakimo, Jr.

[57] ABSTRACT

A fastener device for connecting a grid-like fence panel to a fence post comprises a helical rod presenting a plurality of ring elements therein. In the preferred embodiment, a vertical wire strand in the fence panel is placed adjacent the fence post with the helical rod being positioned so that the fence post protrudes through the lowest ring. Upon rotation of the rod, via a handle at the upper end thereof, the spiral rod winds itself about the fence post and wire elements adjacent thereto so as to join the fence to the post. A locking seat in the handle engages the top horizontal wire of the fence panel to hold the fastener device in place and preclude undesirable movement of the same away from its functional position. The fastener may be used to join a fence post to one or more wire panels and to join first and second wire panels to each other without the use of a fence post therewith.

20 Claims, 4 Drawing Figures

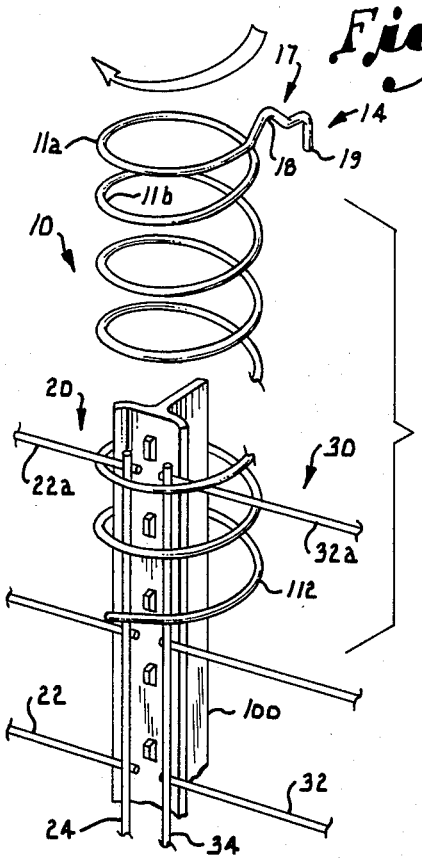
Fig. 1.
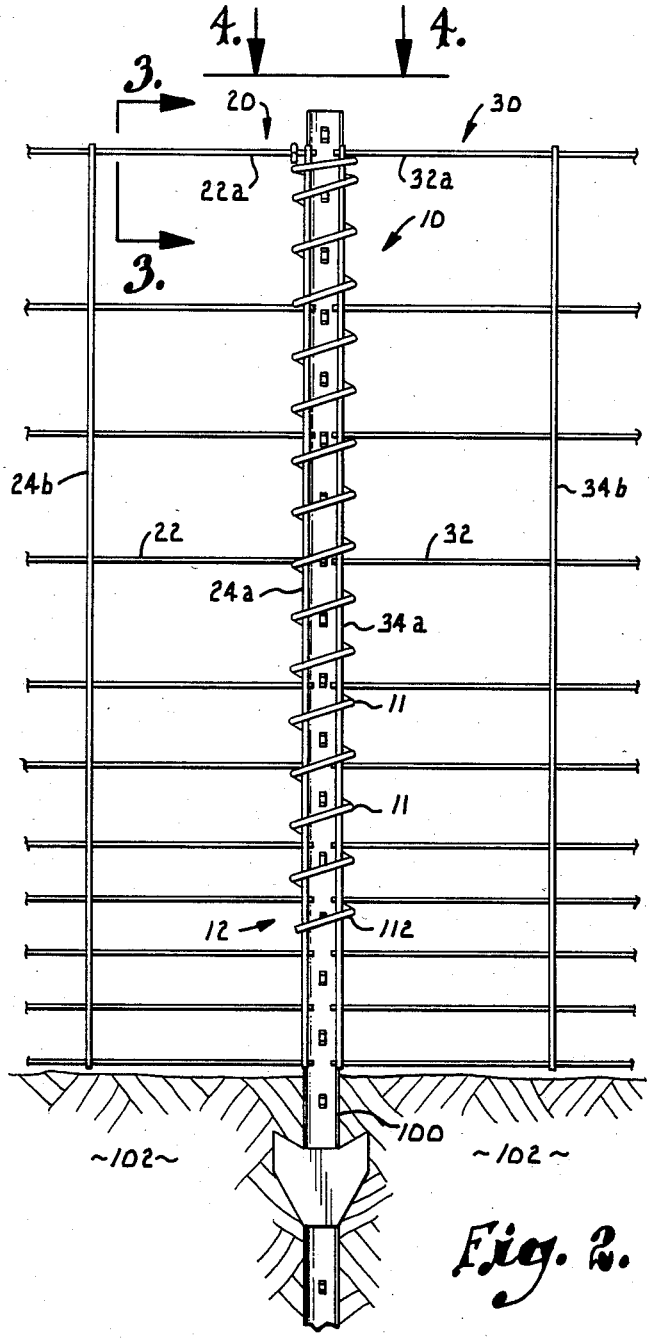
Fig. 2.
Fig. 3.
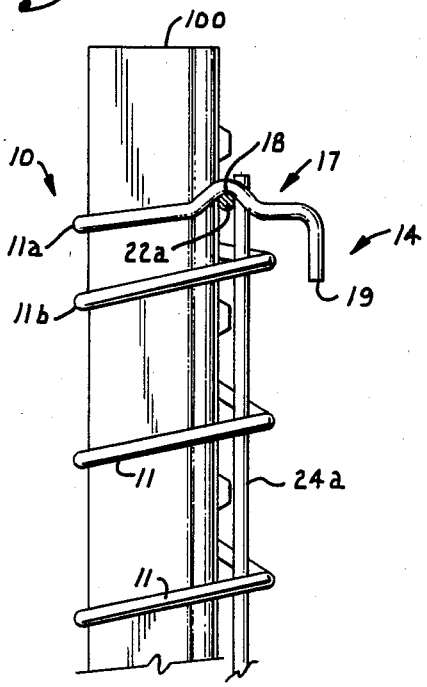
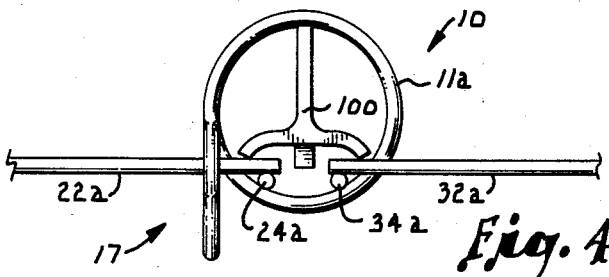
Fig. 4.

LATCH FOR LIVESTOCK PANELS

BACKGROUND OF THE INVENTION

This invention pertains to a fastener device for latching a livestock fence panel(s) to a fence post and/or each other, and more particularly, to a fastener device having a locking element therein to preclude undesirable movement of the fastener from its functional position.

Various types of fastener devices have been proposed for attachment of grid-like livestock fence panels to a fence post and/or each other. Such devices have included the use of baling wire, clamps and the like to attach the horizontal and/or vertical wires of the grid-like fence panel to the fence post or to each other.

Although assumably effective in their operation, a plurality of such fastener devices must be used which increases the cost, complexity and duration of installation. Moreover, forces acting on the fence panel, such as livestock pushing against the fence or the like, tend to loosen the fasteners from their functional position which diminishes the structural stability of the fence proper.

In response thereto, I have invented a fastener device in the form of a coiled rod which presents a plurality of vertically, spaced-apart concentric ring elements between the upper and lower free ends of the rod. Upon placing a portion of a grid-like fence panel(s) adjacent a grounded fence post, the rod is positioned so that the upper end of the fence post protrudes through the lowest concentric ring of the helical rod. A handle member, defining the upper free end of the rod, is turned by the installer so that the spring-like rod is rotated about its central longitudinal axis. This rotation winds the lower free end and ring elements of the rod about the fence post and about the vertical and/or horizontal wire elements of the respective panels adjacent thereto. Accordingly, the winding of the rod confines the wire strands, particularly the vertical strands, within the concentric rings and preferrably contiguously adjacent the fence post. This relationship joins the fence panel(s) to the post and presents a stable panel(s)/post interface. The user-operable handle includes a recessed portion therein which forms a seat for releasably receiving a portion of the top horizontal wire of the grid-like fence panel therein. Engagement of the seat of the handle with the horizontal wire precludes further, undesirable movement of the rod about the fence post so as to maintain the fastener in its desired functional position.

In certain cases, the helical fastener may be used to join first and second fence panels one to the other without the use of a fence post adjacent thereto.

It is therefore a general object of this invention to provide a fastener device for connecting a fence panel to a fence post or adjacent fence panels one to the other.

Another object of this invention is to provide a fastener device, as aforesaid, in the form of a helical rod which is user rotatable about its longitudinal axis in a manner to wind itself about a fence post and the grid-like wire elements of the adjacent fence panel to be connected thereto.

A further object of this invention is to provide a fastener device, as aforesaid, which is user rotatable about its longitudinal axis so as to be intertwined about the ends of two adjacent livestock fence panels to provide a connection therebetween.

Still another object of this invention is to provide a fastener element, as aforesaid, having a handle at the upper end thereof to assist the installer in providing said aforesaid user rotation.

A still further object of this invention is to provide a fastener element with handle, as aforesaid, with the latter having a seat therein for receiving a wire of the grid-like fence panel therein to preclude movement of the fastener from its functional latching position.

Other objects and advantages of this invention will become apparent from the following description taken in connection with the accompanying drawings, wherein is set forth by way of illustration and example, an embodiment of this invention.

BRIEF DESCRIPTION OF THE DRAWINGS

FIG. 1 is a foreshortened view of the fastener device showing the lower end in a functional position about a fence post and adjacent fence panels with the upper end in a non-functional position as vertically displaced from the fence post.

FIG. 2 an elevation view showing the functional position of the fastener device latching two adjacent grid-like fence panels to a fence post.

FIG. 3 is a view, taken along line 3—3 in FIG. 2 and on an enlarged scale, illustrating the locking engagement of the handle with the upper horizontal strand of one of the grid-like fence panels in FIG. 2.

FIG. 4 is a top view, taken along line 4—4 in FIG. 2, and showing the interface among the fence post, horizontal and vertical wires of the fence panels, a concentric ring element of the fastener and locking handle.

DESCRIPTION OF PREFERRED EMBODIMENT

Turning more particularly to the drawings, FIG. 2 illustrates the use of my latch fastener 10 attaching first and second livestock fence panels 20, 30 to a grounded 102 fence post 100. Each livestock fence panel 20, 30 has a grid-like configuration as presented by vertically spaced-apart horizontal wire strands 22, 32 and laterally spaced-apart vertical wire strands 24, 34 normal thereto.

The latch 10 is in the form of a helical rod which comprises a plurality of vertically spaced-apart and generally concentric ring elements 11 positioned between the lower 12 and upper 14 free ends of the rod proper. The upper free end 14 of the fastener 10 defines a handle 17 including a recess 18 therein. The terminal end 19 of the handle 17 is downwardly disposed for a purpose to be subsequently described. The diameter of the plurality of concentric ring elements 11 is such that the fence post 100 is insertable therethrough.

In use, the ends of the respective fence panels 20, 30, as presented by the terminal vertical wire strands **24*a*, 34*a*, are positioned adjacent the fence post 100. The top of the fence post 100 is then inserted through the lower ring 11*z* of the fastener 10 as illustrated in FIG. 1. The installer then grasps the handle 17 and turns the same about the imaginary vertical axis extending through the coiled rod. This rotation of the handle 17 about the imaginary vertical axis also rotates the entire helical rod so that the lower free end 12 thereof threads or winds itself about the fence post 100, the horizontal wire strands 22, 32 and vertical wire strands 24*a*, 34*a*. Accordingly, once the plurality of rings 11 of the fastener 10 surround the fence post 100 the respective horizontal 22, 32 and vertical 24*a*, 34*a* wire strands are confined within the rings 11 and held adjacent the fence post 100**.

This relationship, as shown in FIG. 4, latches the ends of the respective fence panels 20, 30 to the fence post 100.

Subsequently, the handle 17 is positioned to extend generally normal to the top horizontal wire strand 22*a* of the fence panel 20. It is here noted that the upper ring 11*a* of the fastener 10 is positioned so as to lie generally normal to the imaginary vertical axis extending therethrough. This position places ring 11*a* relatively closer to the inferiorly disposed ring 11*b* as opposed to the spaced-apart relationships between the other rings 11. Accordingly, the recess 18 or seat positively receives the top horizontal wire 22*a* therein. Moreover, the downward cant of the terminal end 19 of the handle downwardly biases the handle 17 and seat 18 so as to maintain the wire 22*a* in seat 18. This relationship locks fastener 10 to the respective wire panel 20 and precludes further, undesirable movement of the fastener 10 along the fence post 100. Otherwise, forces acting on the panels 20, 30, such as abutting livestock, can cause the rod 10 to creep along the fence post 100 and severe the connection of the top portion(s) of the respective fence panels 20, 30 to the adjacent fence post 100.

Although my fastener 10 with locking mechanism has been shown in the attachment of adjacent fence panels 20, 30 to a fence post 100, it is understood that the fastener 10 can be used to connect a fence post 100 to intermediate portions of a single fence panel 20 or 30 so as to offer structural rigidity thereto. As such, the spring fastener encircles a plurality of horizontal wires 22 and, if desired, a vertical wire 24. Handle 18 again engages the top horizontal wire 22*a* of the respective fence panel 20 so as to maintain fastener 10 in a desired position.

It is also understood that fastener 10 may be used without the fence post 100 so as to connect the respective fence panels 20, 30 in a manner as above described. As such the respective end vertical strands 24*a*, 34*a* are confined within the rings 11 with the fastener 10 joining the ends of the panels 20, 30. Also to enhance the rigidity of the fence proper, the panels 20, 30 may be overlapped so that either one or two interior vertical strands, e.g. 24*b*, 34*b*, are confined within the rings 11. It is understood that in some cases the fastener 10 may wind about only the horizontal strands 22, 32 with no vertical strands passing therethrough. In all cases, the locking means 18 of the fastener 10 engages at least one wire element as above described. Again, the fastener 10 offers structural support to the joined panels 20, 30.

It is to be understood that while certain forms of this invention have been illustrated and described, it is not limited thereto, except in so far as such limitations are included in the following claims.

Having thus described the invention, what is claimed as new and desired to be secured by Letters Patent is:

1. In combination with at least one fence panel having spaced-apart, reinforcing wire elements therein and a fence post for attachment of said at least one fence panel thereto, a fastener device comprising:

a helical rod, said rod having spaced-apart lower and upper ends and presenting a plurality of generally concentric rings therebetween allowing for passage of said post therethrough;

a user-operated handle at the upper end of said rod for rotating said rod about its imaginary axis upon insertion of an upper end of said post through a ring at the lower end of said rod, said rotation causing said rod to wind about said fence post and said wire elements of said fence panel adjacent thereto in a manner to confine portions of said wire elements within the confines of said rings and adjacent said post whereby to connect said panel to said post; and locking means associated with said handle for engagement with a wire element of said fence panel to preclude movement of said handle and rotation of said rod whereby to maintain said position of said rod connecting said fence panel to said post.

2. The apparatus as claimed in claim 1 wherein said handle is presented by the upper free end of said rod.

3. The apparatus as claimed in claim 1 wherein said locking means comprises a seat in said handle for receiving a portion of said wire element therein.

4. The apparatus as claimed in claim 3 wherein said seat releasably engages a horizontal wire element of said fence panel therein.

5. The apparatus as claimed in claim 3 wherein said concentric ring of said rod at said upper end is positioned generally normal to said imaginary axis in a manner to position said seat adjacent a wire element of said panel to facilitate said reception of said wire in said seat.

6. The apparatus as claimed in claim 5 wherein said wire is a horizontal wire in said fence panel.

7. The apparatus as claimed in claim 5 wherein the terminus of said handle member is configured to cause said seat to bear against said received wire whereby to maintain said wire within said seat.

8. The apparatus as claimed in claim 6 wherein the terminus of said handle is configured to present a downward bias of said seat against said received wire whereby to maintain said horizontal wire within said seat.

9. The apparatus as claimed in claim 1 wherein said wire elements of said fence panel are in a grid-like relationship to present horizontal and vertical wire elements therein with at least said horizontal wire elements being positioned adjacent said fence post, said rod winding about said at least horizontal elements to connect said panel to said post.

10. The apparatus as claimed in claim 9 wherein a vertical wire element lies adjacent said fence post wherein said rod winds about said horizontal wire elements and said vertical wire element to connect said panel to said post.

11. A fastener device for joining first and second fence panels with each of said panels having horizontal and vertical wire strands therein comprising:

a helical rod, said rod having spaced-apart lower and upper ends and presenting a plurality of generally concentric ring elements allowing for passage of at least a vertical wire of one of said fence panels therethrough;

a user-operated handle at the upper end of said rod for rotating said rod about its imaginary axis upon insertion of an end of said at least one vertical wire through a ring adjacent one of said ends of said rod, said rotation causing said rod to wind about said at least one vertical wire and horizontal wires of said respective fence panels adjacent thereto in a manner to confine at least said one vertical wire and portions of said horizontal wires within said rings whereby to connect said first panel to said second panel; and locking means associated with said handle for engagement with a wire of at least one of said fence panels to preclude movement of said handle and rotation of said rod whereby to maintain said connecting position of said rod connecting said first and second fence panels.

12. The apparatus as claimed in claim 11 wherein said handle is presented by the upper free end of said rod.

13. The apparatus as claimed in claim 11 wherein said locking means comprises a seat in said handle for receiving a portion of said wire element therein.

14. The apparatus as claimed in claim 13 wherein said seat releasably engages a horizontal wire element of said fence panel therein.

15. The apparatus as claimed in claim 13 wherein the concentric ring of said rod at said upper end is positioned generally normal to said imaginary axis in a manner to position said seat adjacent a wire element of said panel to facilitate said reception of said wire in said seat.

16. The apparatus as claimed in claim 15 wherein said wire is a horizontal wire in said fence panel.

17. The apparatus as claimed in claim 15 wherein the terminus of said handle member is configured to cause said seat to bear against said received wire whereby to maintain said wire within said seat.

18. The apparatus as claimed in claim 16 wherein the terminus of said handle is configured to present a downward bias of said seat against said received wire whereby to maintain said horizontal wire within said seat.

19. The apparatus as claimed in claim 11 wherein a vertical wire of each panel passes through said rings whereby said rod winds its way about the vertical and horizontal wires of each panel.

20. The apparatus as claimed in claim 19 wherein said vertical wires are at the eds of each panel whereby to connect said firt and second panels in an end-to-end relationship

* * * * *

UNITED STATES PATENT AND TRADEMARK OFFICE

CERTIFICATE OF CORRECTION

PATENT NO. : 4,595,176

DATED : June 17, 1986

INVENTOR(S) : CHARLEY B. CRABTREE

It is certified that error appears in the above—identified patent and that said Letters Patent is hereby corrected as shown below:

Claim 20, line 15: delete "eds" and substitute --ends--.

Claim 20, line 16: delete "firt" and substitute --first--.

Claim 20, line 17: add a period after the word "relationship".

Signed and Sealed this

Fourteenth Day of October, 1986

[SEAL]

*Attest:*

DONALD J. QUIGG

*Attesting Officer*

*Commissioner of Patents and Trademarks*